US008038500B2

(12) United States Patent
Thai

(10) Patent No.: US 8,038,500 B2
(45) Date of Patent: Oct. 18, 2011

(54) BUBBLE GENERATING ASSEMBLY

(75) Inventor: Douglas Thai, Walnut, CA (US)

(73) Assignee: Arko Development Limited, Hong Kong (HK)

( * ) Notice: Subject to any disclaimer, the term of this patent is extended or adjusted under 35 U.S.C. 154(b) by 962 days.

(21) Appl. No.: 12/001,117

(22) Filed: Dec. 10, 2007

(65) Prior Publication Data

US 2009/0149107 A1 Jun. 11, 2009

(51) Int. Cl.
*A63H 33/28* (2006.01)

(52) U.S. Cl. ..... 446/15; 446/176; 446/179

(58) Field of Classification Search ..... 446/15–21, 446/179, 176

See application file for complete search history.

(56) References Cited

U.S. PATENT DOCUMENTS

| | | | |
|---|---|---|---|
| 185,279 | A | 12/1876 | Baker et al. |
| 430,095 | A | 6/1890 | Thain |
| 616,239 | A | 12/1898 | King |
| 660,485 | A | 10/1900 | Bradshaw |
| 2,041,423 | A | 5/1936 | Mausolf |
| 2,213,391 | A | 9/1940 | Gamble |
| 2,225,702 | A | 12/1940 | Lyon, Jr. |
| 2,393,039 | A | 1/1946 | Gilchrist, Jr. |
| 2,396,433 | A | 3/1946 | Pimblett |
| 2,398,513 | A | 4/1946 | Bradley |
| 2,412,732 | A | 12/1946 | Holman |
| 2,527,935 | A | 10/1950 | Joel, II |
| 2,547,825 | A | 4/1951 | King |
| 2,560,582 | A | 7/1951 | Limber |
| 2,587,537 | A | 2/1952 | Scott |
| 2,606,396 | A | 8/1952 | Hill |
| 2,632,281 | A | 3/1953 | Schmidt, Jr. |
| 2,659,177 | A | 11/1953 | Kopf |
| 2,700,845 | A | 2/1955 | Arliss |
| 2,711,051 | A | 6/1955 | Pick |
| 2,736,988 | A | 3/1956 | Fisher |
| D185,805 | S | 8/1959 | Clark |
| 2,974,438 | A | 3/1961 | Hopkins |
| 2,987,847 | A | 6/1961 | Jones |
| 3,008,263 | A | 11/1961 | Ellman |
| 3,071,888 | A | 1/1963 | Knott |
| 3,100,947 | A | 8/1963 | Hellman |

(Continued)

FOREIGN PATENT DOCUMENTS

GB 2042350 A * 9/1980

OTHER PUBLICATIONS

Little Tikes "Bubble Bellies", 2005 The little Tikes Company distributed by Imperial Toy Corp., Los Angeles, CA 90021.

*Primary Examiner* — Gene Kim
*Assistant Examiner* — Urszula M Cegielnik
(74) *Attorney, Agent, or Firm* — Raymond Sun

(57) ABSTRACT

A bubble generating assembly has a housing having a motor, an air generator and a bubble producing device associated therewith. The assembly also includes a source of bubble solution, and a pump system provided inside the housing that draws bubble solution from the source to the bubble producing device. The bubble producing device includes a tubular member having an inner surface and an outer surface, and oriented so that air from the air generator will flow along both the inner and outer surfaces, and where bubble solution coats both the inner and outer surfaces.

10 Claims, 6 Drawing Sheets

U.S. PATENT DOCUMENTS

| | | | | |
|---|---|---|---|---|
| 3,109,255 | A | 11/1963 | Hein | |
| 3,183,621 | A | 5/1965 | Allen, Jr. | |
| 3,228,136 | A | 1/1966 | Rouse | |
| 3,323,250 | A | 6/1967 | Gibbons | |
| 3,420,412 | A | 1/1969 | Greene | |
| 3,579,898 | A | 5/1971 | Hein | |
| 3,601,313 | A | 8/1971 | Berg | |
| 3,604,144 | A | 9/1971 | Span | |
| 3,731,412 | A | 5/1973 | Winslow | |
| 3,736,694 | A | 6/1973 | Lebensfeld | |
| 3,845,583 | A | 11/1974 | Ziff | |
| 3,913,260 | A | 10/1975 | Corbett | |
| 3,925,923 | A | 12/1975 | La Fata et al. | |
| 3,952,447 | A | 4/1976 | Hackell | |
| 4,246,717 | A | 1/1981 | Wachtel | |
| D263,062 | S | 2/1982 | Rasmussen | |
| 4,423,565 | A | 1/1984 | Bart | |
| 4,438,955 | A | 3/1984 | Ryan | |
| 4,447,982 | A | 5/1984 | Gushea | |
| 4,467,552 | A | 8/1984 | Jernigan | |
| 4,481,731 | A | 11/1984 | La Fata et al. | |
| 4,603,021 | A | 7/1986 | Urso | |
| 4,700,965 | A | 10/1987 | Kinberg | |
| 4,775,348 | A | 10/1988 | Collins | |
| 4,804,346 | A | 2/1989 | Sheng | |
| RE32,973 | E | 7/1989 | Panzarella | |
| D304,466 | S | 11/1989 | Glickman | |
| 4,957,464 | A | 9/1990 | Perez | |
| 4,988,319 | A | 1/1991 | Shen | |
| 5,035,665 | A | 7/1991 | Sheng | |
| 5,230,648 | A | 7/1993 | Kelly et al. | |
| 5,234,129 | A | 8/1993 | Lau | |
| 5,395,274 | A | 3/1995 | Myers | |
| 5,462,469 | A | 10/1995 | Lei | |
| 5,498,191 | A | 3/1996 | DeMars | |
| 5,520,564 | A | 5/1996 | DeMars | |
| 5,542,869 | A | 8/1996 | Petty | |
| 5,613,890 | A | 3/1997 | DeMars | |
| 5,695,379 | A | 12/1997 | Ho | |
| 5,832,969 | A | 11/1998 | Schramm | |
| 5,842,899 | A | 12/1998 | Cernansky et al. | |
| 5,850,945 | A | 12/1998 | Frankel | |
| 5,879,218 | A | 3/1999 | Tao | |
| 6,062,935 | A | 5/2000 | Gross | |
| 6,102,764 | A | 8/2000 | Thai | |
| 6,139,391 | A | 10/2000 | Thai | |
| 6,149,486 | A | 11/2000 | Thai | |
| 6,200,184 | B1 | 3/2001 | Rich et al. | |
| 6,315,627 | B1 | 11/2001 | Thai | |
| 6,331,130 | B1 | 12/2001 | Thai | |
| 6,416,377 | B1 | 7/2002 | Bart | |
| 6,544,091 | B1 | 4/2003 | Thai | |
| 6,547,622 | B2 | 4/2003 | Thai | |
| 6,572,427 | B1 * | 6/2003 | Thai | 446/15 |
| 6,616,498 | B1 * | 9/2003 | Thai | 446/15 |
| 6,620,015 | B2 * | 9/2003 | Thai | 446/15 |
| 6,620,016 | B1 | 9/2003 | Thai | |
| 6,659,830 | B2 | 12/2003 | Thai | |
| 6,682,570 | B2 * | 1/2004 | Thai | 446/15 |
| 6,893,314 | B2 | 5/2005 | Thai | |
| 6,921,312 | B2 * | 7/2005 | Thai | 446/15 |
| 6,969,293 | B2 * | 11/2005 | Thai | 446/15 |
| 6,988,926 | B2 | 1/2006 | Thai | |
| 7,008,287 | B2 * | 3/2006 | Thai | 446/15 |
| 7,021,986 | B2 * | 4/2006 | Thai | 446/15 |
| 7,052,356 | B2 * | 5/2006 | Thai | 446/15 |
| 7,172,485 | B2 * | 2/2007 | Thai | 446/15 |
| 7,182,665 | B2 * | 2/2007 | Thai | 446/15 |
| 7,223,149 | B2 * | 5/2007 | Thai | 446/15 |
| 7,367,861 | B2 * | 5/2008 | Thai | 446/15 |
| 2002/0061697 | A1 | 5/2002 | Hornsby et al. | |
| 2005/0142979 | A1 * | 6/2005 | Thai | 446/15 |
| 2005/0282461 | A1 * | 12/2005 | Thai | 446/15 |
| 2006/0141895 | A1 * | 6/2006 | Thai | 446/15 |
| 2006/0199463 | A1 * | 9/2006 | Thai | 446/15 |
| 2007/0037467 | A1 * | 2/2007 | Thai | 446/15 |
| 2007/0117491 | A1 * | 5/2007 | Thai | 446/15 |
| 2007/0275630 | A1 * | 11/2007 | Thai | 446/15 |

* cited by examiner 110
100
114
112
104
118
120
108
102
116
106
122
34
92
96
62
90
94
126
128

BUBBLE GENERATING ASSEMBLY

BACKGROUND OF THE INVENTION

1. Field of the Invention

The present invention relates to bubble toys, and in particular, to a bubble generating assembly which has reduced overall size, and which generates a stream of bubbles without the need to dip any component of the assembly into a container or a dish of bubble solution.

2. Description of the Prior Art

Bubble producing toys are very popular among children who enjoy producing bubbles of different shapes and sizes. Many bubble producing toys have previously been provided. Recently, many bubble generating assemblies have been provided where a film of bubble solution is formed across a bubble ring without the need to dip the bubble ring into a dish of bubble solution. A stream of air is directed towards the film of bubble solution to generate a stream of bubbles. Examples of such bubble generating assemblies are shown in U.S. Pat. Nos. 7,223,149 (Thai), 6,682,570 (Thai), 6,755,710 (Thai), 7,144,291 (Thai), 7,182,665 (Thai) and 7,172,484 (Thai), among others. Most of these assemblies include a pump system which delivers bubble solution from a bubble source (e.g., a bottle) to the bubble ring, a linkage that moves a component (either a stationary bar or the bubble ring itself) to form a film of bubble across the bubble ring, and an actuator that turns on a fan to direct the stream of air at the film of bubble solution.

While these bubble generating assemblies have been effective in producing streams of large and small bubbles, and in bringing considerable entertainment and fun to children, most of these assemblies are quite large because the internal mechanisms that are needed to produce the bubbles take up a lot of space. For example, the linkage and the actuator for the fan can involve a number of different components that together occupy a lot of space.

Therefore, there still remains a need for a bubble generating assembly which has reduced overall size, and which generates a stream of bubbles without the need to dip any component of the assembly into a container or a dish of bubble solution to form a film of bubble solution.

SUMMARY OF THE DISCLOSURE

It is an object of the present invention to provide an apparatus and method for effectively forming a film of bubble solution across a bubble ring.

It is another object of the present invention to provide an apparatus having a simple construction and reduced size, that effectively forms a film of bubble solution across a bubble ring.

The objectives of the present invention are accomplished by providing a bubble generating assembly that has a housing having a motor, an air generator and a bubble producing device associated therewith. The assembly also includes a source of bubble solution, and a pump system provided inside the housing that draws bubble solution from the source to the bubble producing device. The bubble producing device includes a tubular member having an inner surface and an outer surface, and oriented so that air from the air generator will flow along both the inner and outer surfaces, and where bubble solution coats both the inner and outer surfaces.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

Figure 9:
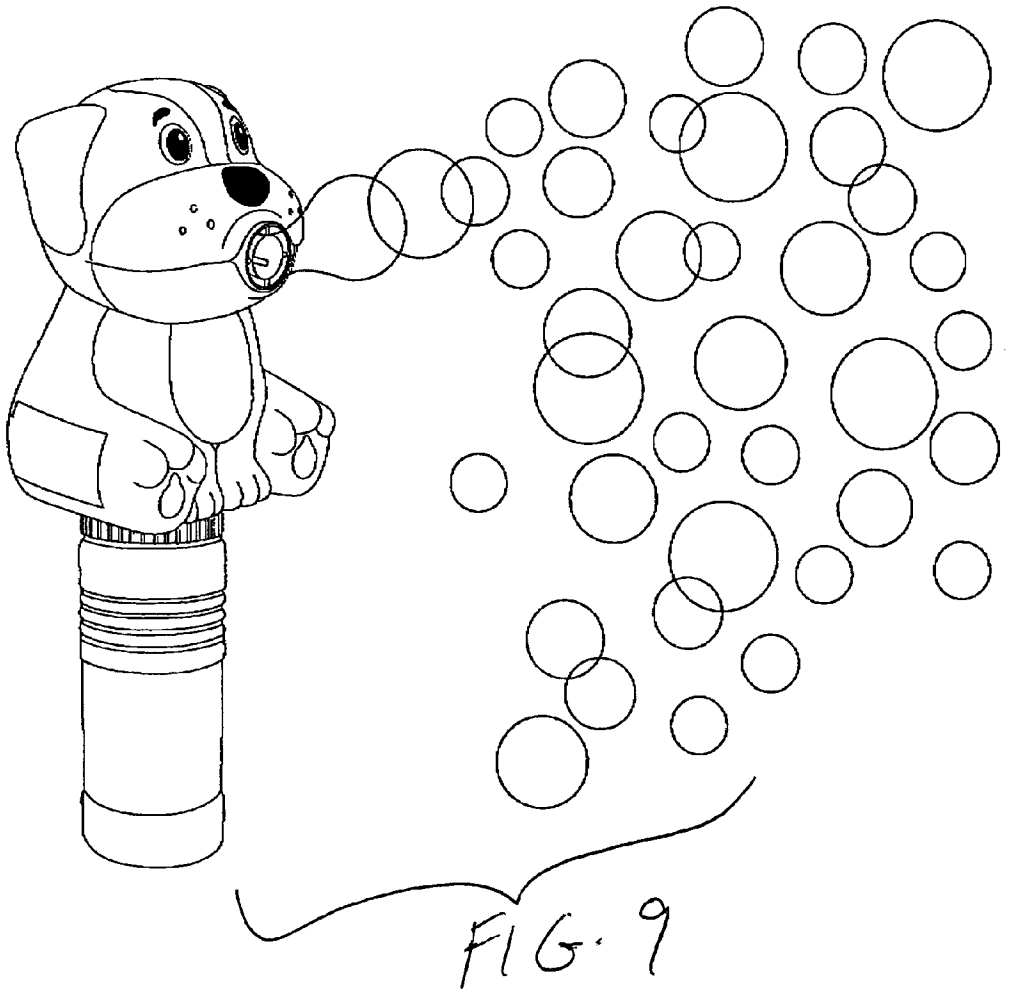
FIG. 9 is a front perspective view of a bubble generating assembly according to another embodiment of the present invention shown with the housing configured like an animal.

FIGS. 1-7 illustrate one embodiment of a bubble generating assembly 20 according to the present invention. The assembly 20 has a housing 22 and a bubble solution container 24. The housing 22 can assume any shape, including the shape of an animal (see FIG. 9). The housing 22 can be provided in the form of two symmetrical outer shells 23*a*, 23*b* (see also FIG. 2) that are connected together by, for example, screws or welding or glue. These outer shells together define a hollow interior for housing the internal components of the assembly 20, as described below. A switch 26 and a battery cover 28 are provided on the rear of the housing 22. The solution container 24 has a threaded neck (not shown) that is adapted to be threadably connected to internal threads 32 on an annular connector 30 (see also FIG. 2). A tubing 34 extends from the interior of the solution container 24, through an opening in the top wall of the connector 30, and into the interior of the housing 22. The connector 30 is positioned at the bottom of the housing 22. The solution container 24 is adapted to hold bubble solution, and can be made of a transparent material (e.g., plastic) so that the user can see the fill-level of the bubble solution in the solution container 24.

The housing 22 has a barrel section 34 that extends from the top of the housing 22. The barrel section 34 houses a bubble producing device 36 which is shown in greater detail in FIG. 4A. The barrel section 34 has an opening 38 through which bubbles produced by the bubble producing device 36 can be ejected.

Figure 1A:
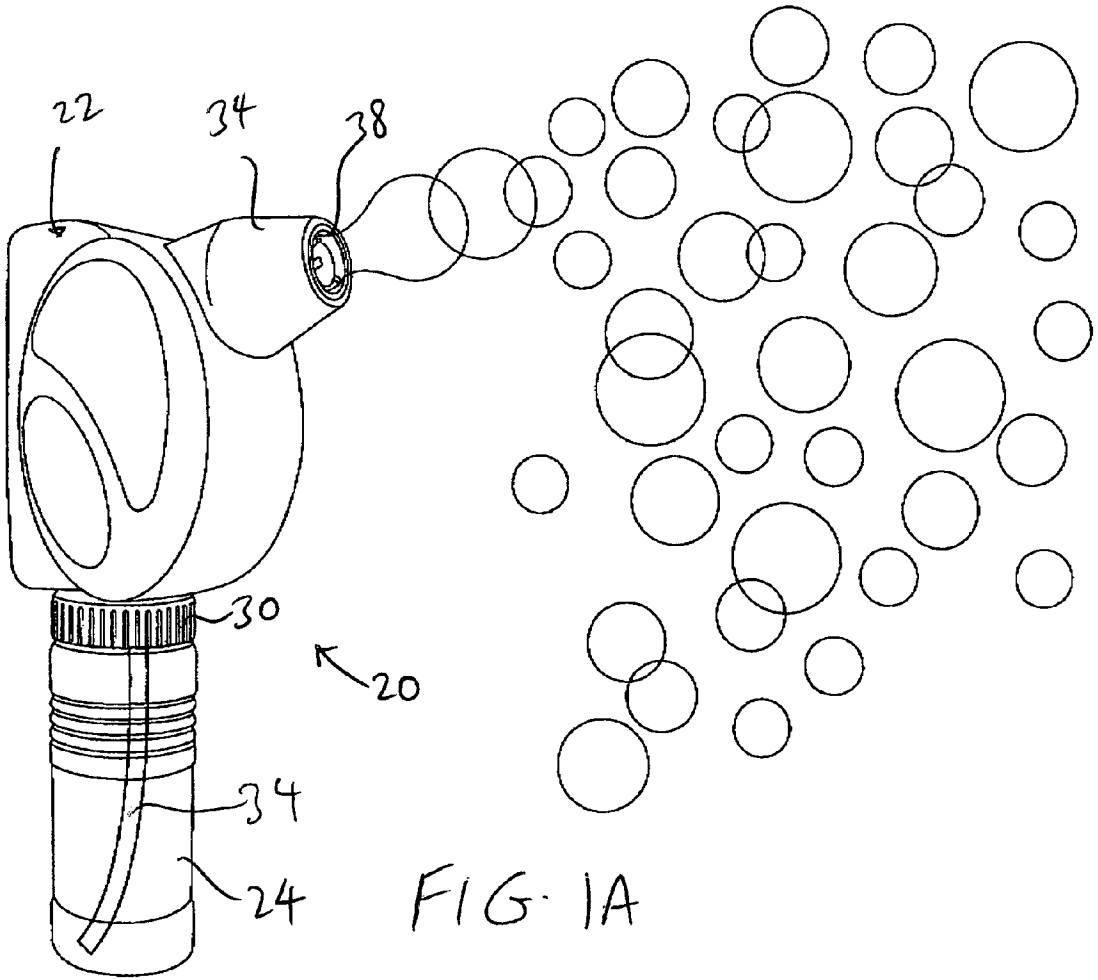
FIG. 1A is a front perspective view of a bubble generating assembly according to one embodiment of the present invention shown producing a plurality of bubbles.
Figure 1B:
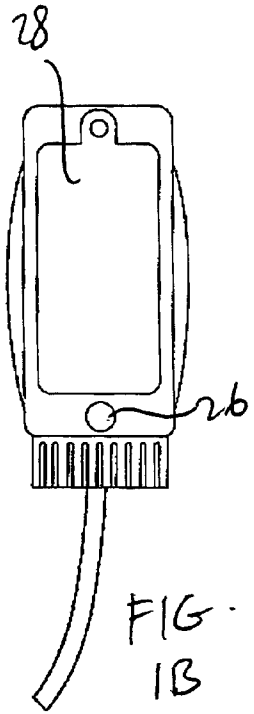
FIG. 1B is a rear view of the assembly of FIG. 1A.
Figure 2:
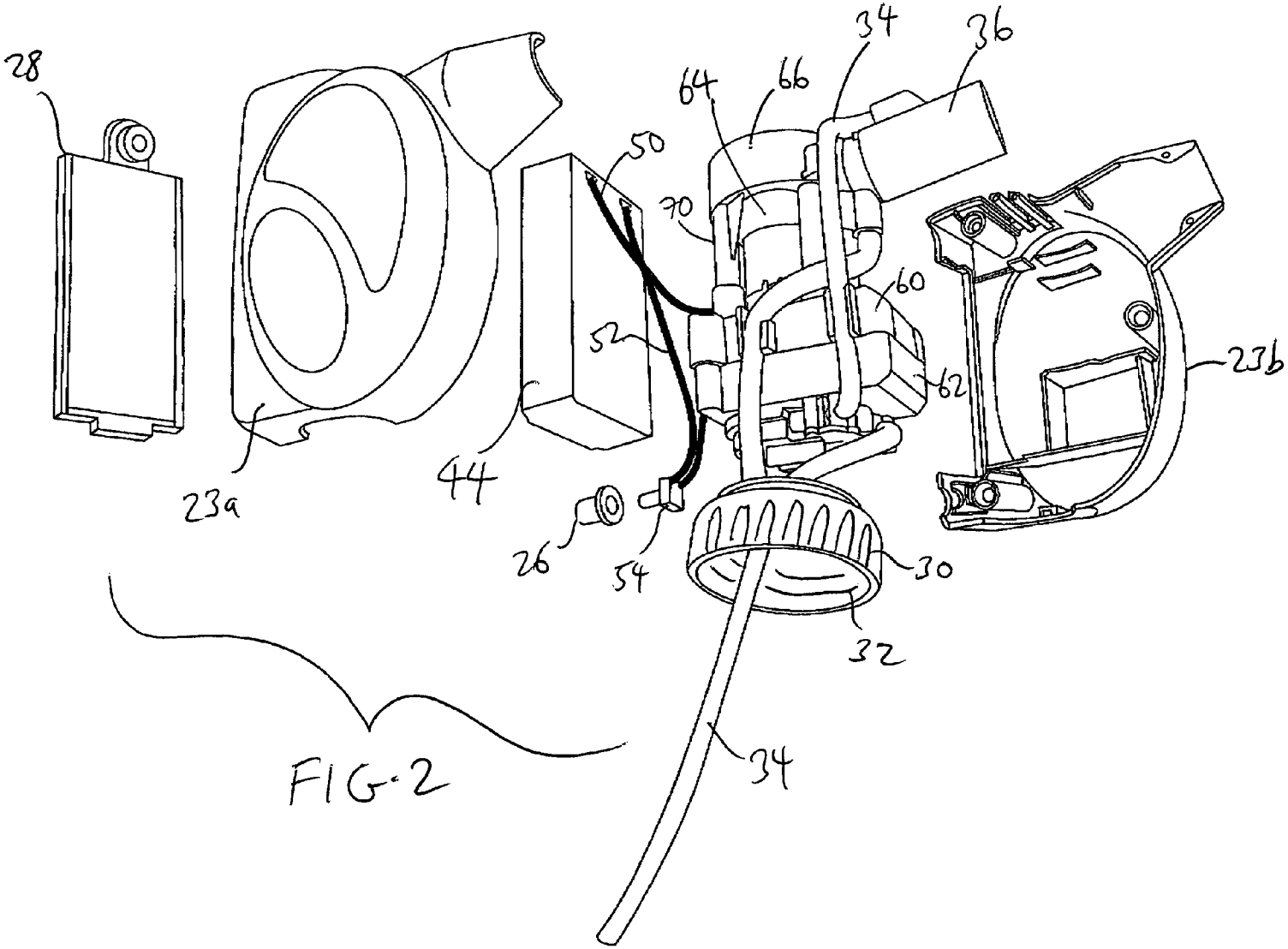
FIG. 2 is an exploded perspective view of the internal components of the assembly of FIG. 1A.
Figure 3:
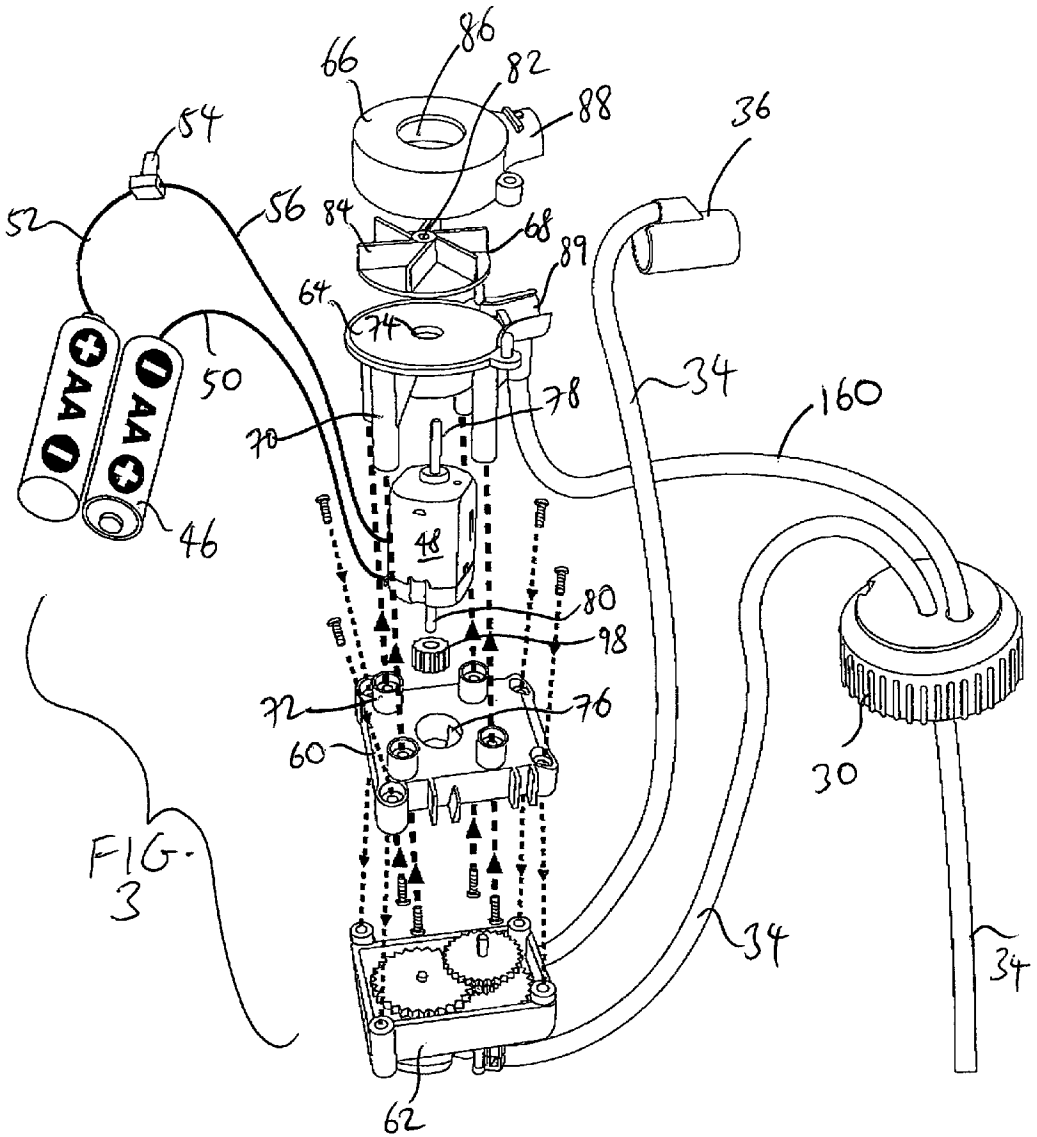
FIG. 3 is an exploded perspective view of some of the internal components of the assembly of FIG. 1A.
Figures 4A, 4B, 4C, 4D:
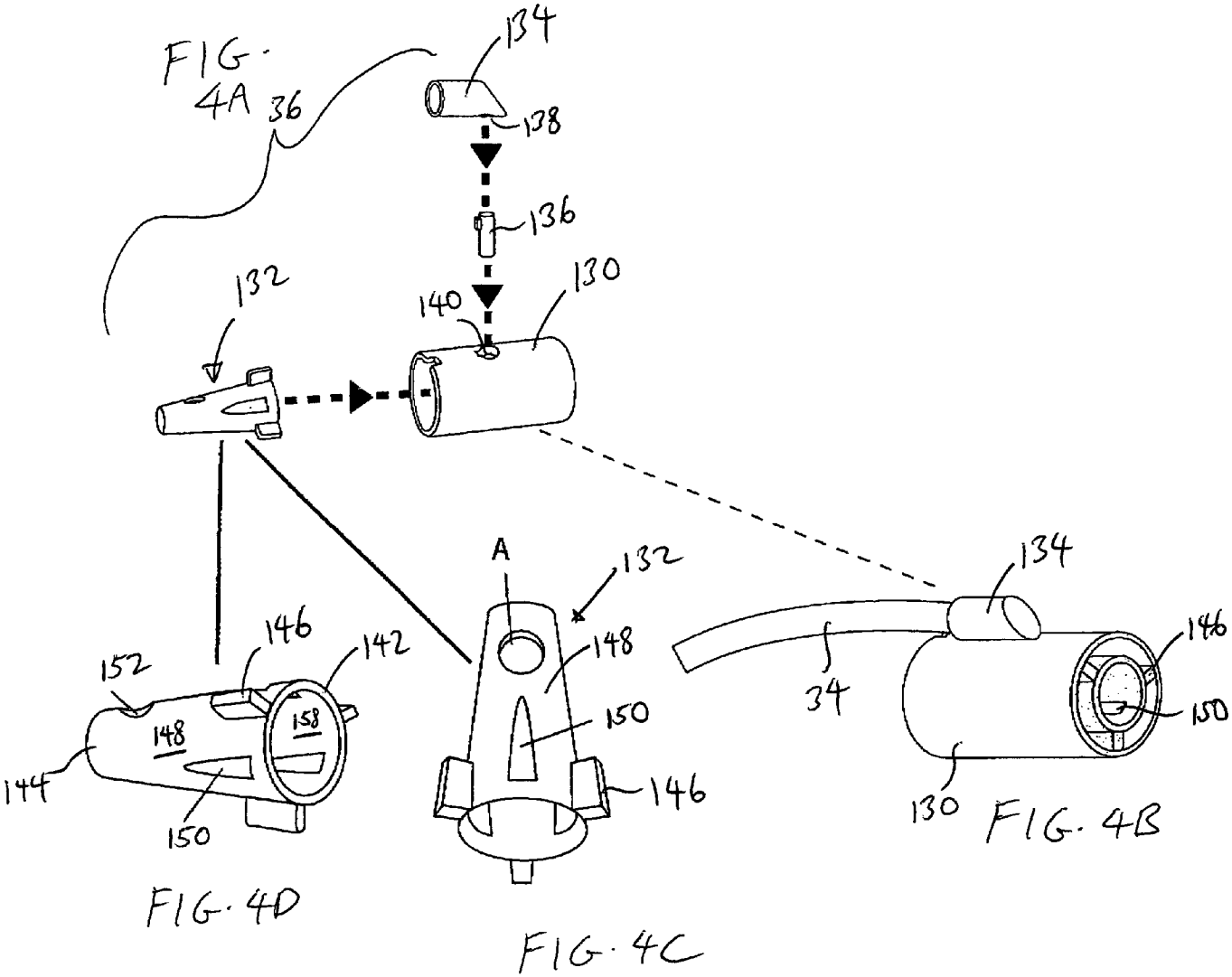
FIG. 4A is an exploded perspective view of the bubble producing device of the assembly of FIG. 1A.
FIG. 4B is an assembled perspective view of the bubble producing device of FIG. 4A.
FIGS. 4C and 4D are different perspective views of the conical member of the bubble producing device of FIG. 4A.
Figures 5, 6, 7, 8:
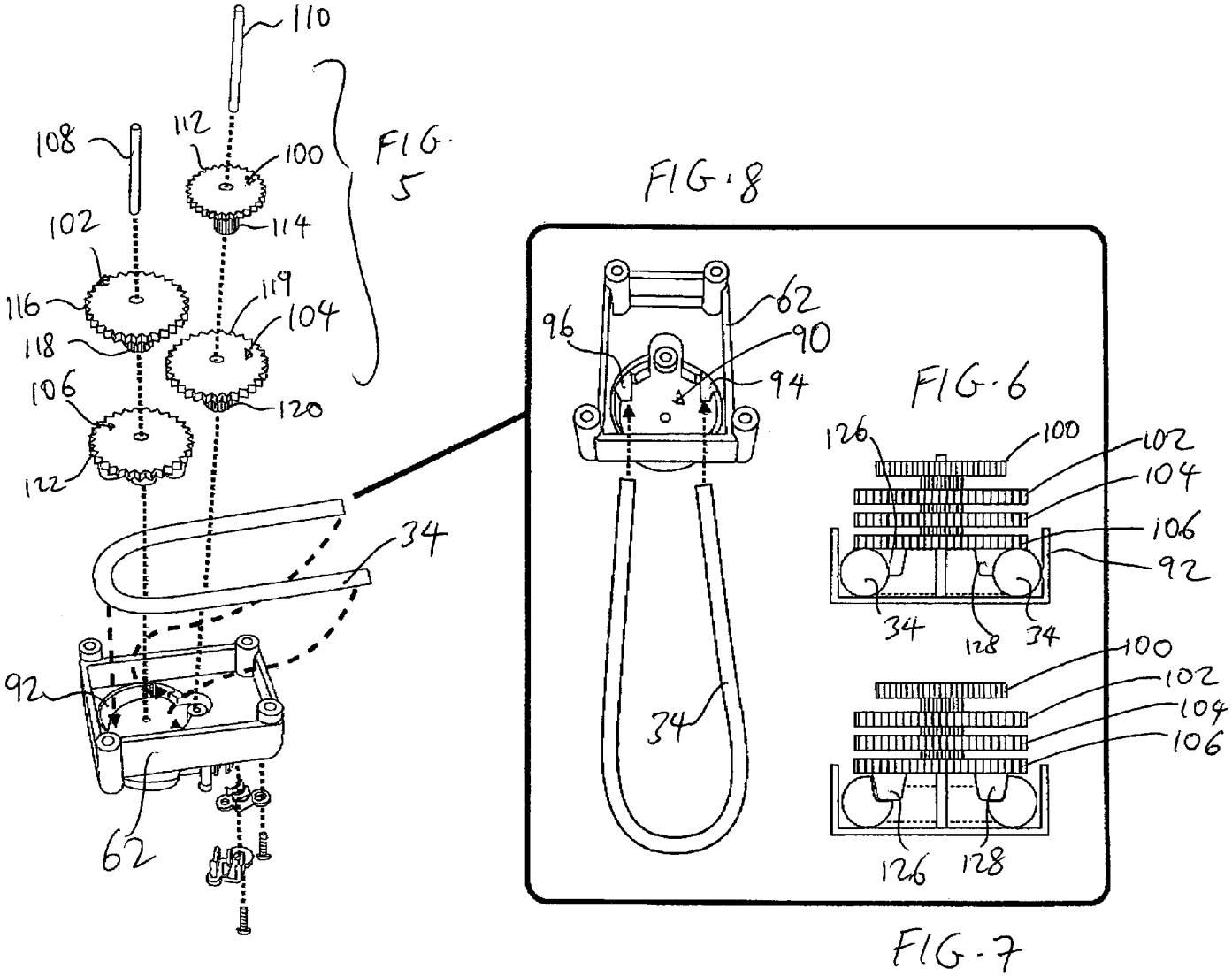
FIG. 5 is an exploded view of the pump system of the assembly of FIG. 1A.
FIGS. 6 and 7 illustrate how the pump pusher actuates the pump of the assembly of FIG. 1A.
FIG. 8 is an exploded view of the bottom piece of the pump housing of the assembly of FIG. 1A.

Referring to FIGS. 2 and 3, the housing 22 houses a power source which includes a battery compartment 44 that retains at least one conventional battery 46. A motor 48 is electrically coupled to the power source via a first wire 50. A second wire 52 couples the power source to a contact 54. A third wire 56 couples the contact 54 to the motor 48. The contact 54 is adapted to releasably contact the switch 26 to form a closed electrical circuit.

The motor 48 is received in a motor mount that is made up of a gear housing and a fan housing. The gear housing includes a top piece 60 and a bottom piece 62 that together defines an interior space for receiving the gear system and the pump system described below. The fan housing includes a fan support base 64 and an upper housing 66 that defines an interior space for receiving an air generator 68 (e.g., a fan). A plurality of legs 70 extend from the bottom of the fan support base 64, with each leg 70 secured inside a separate receiving well 72 provided on the top piece 60. The motor 48 is mounted on top of the top piece 60 between the top piece 60 and the fan support base 64, and between the legs 70. An opening 74 is provided in the fan support base 64 to allow a top shaft 78 of the motor 48 to extend through, and similarly, an opening 76 is provided in the top piece 60 to allow a bottom shaft 80 of the motor 48 to extend through into the interior of the pump housing to operatively engage a gear of the pump system. The top shaft 78 extends through the central bore 82 of the fan 68 to allow the motor 48 to rotate the fan 68 and its blades 84. An opening 86 is provided in the upper housing 66 through which external air can be directed in to the fan 68. A barrel 88 extends from the front of the fan housing, and is adapted to direct air towards the bubble producing device 36 positioned inside the barrel section 36.

A pump system (described in greater detail below) is operatively coupled to the motor 48 via the bottom shaft 80, and is positioned inside the pump housing to pump the bubble solution from the solution container 24 to the bubble producing device 36. Referring also to FIGS. 5-8, the pump system includes the motor 48, the tubing 34, a guide well 90 provided in the bottom piece 62 of the pump housing, and a gear system that functions to draw bubble solution through the tubing 34. The guide well 90 is recessed downwardly from the bottom piece 62, and has a circular wall 92, with two openings 94, 96 provided in the circular wall 92. The tubing 34 extends under the bottom piece 62 and enters through an opening 94 at about the one o'clock position (as viewed from the orientation of FIG. 8), conforms to the circular wall 92, and then exits through an opening 96 at about the eleven o'clock position (as viewed from the orientation of FIG. 8). The gear system includes a motor gear 98 (see FIG. 3) that is rotatably coupled to the bottom shaft 80 of the motor 48, a first gear 100, a second gear 102, a third gear 104, a fourth gear 106, and two pressure rollers 126 and 128 that are secured to the bottom surface of the fourth gear 106. A gear shaft 108 extends from the bottom piece 62 through bores in the gears 102 and 106 into receiving bores (not shown) at the top piece 60, to rotatably connect the gears 102 and 106 to the pieces 60, 62. Similarly, a gear shaft 110 extends from the bottom piece 62 through bores in the gears 100 and 104 into receiving bores (not shown) at the top piece 60, to rotatably connect the gears 100 and 104 to the pieces 60, 62.

The motor gear 98 has teeth that are engaged with the teeth 112 of the first gear 100. The first gear 100 has a different set of teeth 114 that are engaged with the teeth 116 of the second gear 102, the second gear 102 has a different set of teeth 118 that are engaged with the teeth 119 of the third gear 104, and the third gear 104 has a different set of teeth 120 that are engaged with the teeth 122 of the fourth gear 104. The first and third gears 100 and 104 rotate about an axis defined by the shaft 110, and the second and fourth gears 102 and 106 rotate about an axis defined by the shaft 108. The pressure rollers 126, 128 are spaced apart along the outer periphery of the fourth gear 106. Each pressure roller 126, 128 has a truncated cone configuration which has a largest diameter at a base section where the roller 126, 128 is connected to the fourth gear 106, with the diameter decreasing to a smallest diameter at an end at its furthest distance from the fourth gear 106. The tubing 34 is received inside the guide well 90 conforming against the curvature of the circular wall 92.

The pump system operates in the following manner. When the switch 26 is pressed, the closure of the electrical circuit will cause the motor 48 to be actuated, thereby causing the motor 48 to rotate its bottom shaft 80 and causing the gears 100, 102, 104, 106 to rotate. As the fourth gear 106 rotates, the rollers 126, 128 will also rotate because they are carried by the fourth gear 106. As the rollers 126, 128 rotate, they will apply selected pressure on different parts of the tubing 34 in the manner described below to draw bubble solution from the solution container 24, through the tubing 34, to the bubble producing device 36. This is shown in the transition from FIG. 6 to FIG. 7. At the same time, actuation of the motor 48 will rotate the top shaft 78, thereby causing the fan 68 to cause air to be generated and directed through the barrel section 34.

The tubing 34 extends from the pump housing along the external side of the legs 70 and the fan housing, and terminates at a receiving tube 134 of the bubble producing device 36. The bubble producing device 36 also includes a generally cylindrical housing 130 that houses a tubular member 132. The housing 130 is slid over the mouth of the barrel 88 (see FIGS. 2 and 3). The receiving tube 134 is positioned above the housing 130, and a delivery tube 136 extends through an opening 138 in the receiving tube 134, and an opening 140 in the housing 130, so that bubble solution from the tubing 34 can flow through the tubes 134, 136 and into the interior of the housing 130.

The member 132 can be a conical member that has a diameter that gradually decreases from its front end 142 to its rear end 144. A plurality of spacing elements, such as fins 146, are provided in spaced-apart manner about the outer surface 148 of the member 132 at the front end 142. The fins 146 function to space the outer surface 148 of the member 132 from the housing 130, so as to allow the bubble solution to flow through the flow openings 150 (as described below). A plurality of triangular-shaped flow openings 150 are provided in spaced-apart manner about the outer surface 148 adjacent the front end 142, and an opening 152 is provided adjacent the rear end 144. The bottom of the delivery tube 136 extends through the opening 152 so that bubble solution can be delivered through the opening 152 into the interior of the member 132.

In operation, airflow from the fan 68 is delivered through the barrel 88 into the cylindrical housing 130. The air that enters the housing 130 will be divided into two paths. A first path will direct air into the interior of the member 132, and a second path with direct air between the member 132 (along the outer surface 148) and the housing 130. The air from the first path will cause the bubble solution inside the member 132 to flow from the rear end 144 to the front end 142. During such forward flow, the bubble solution will coat the inner surface 158 of the member 132 to form a film of bubble solution along the inner surface 158, and some of the bubble solution will flow out of the plurality of openings 150 and coat the outer surface 148 to form a film of bubble solution along the outer surface 148. A stream of continuous bubbles (see FIG. 1) is produced as air from both the first and second paths travels past the inner and outer surfaces of the member 132. In particular, the air from the first path will brush the inner surface 158 of the member 132, creating a stream of bubbles, and the air from the second path will brush the outer surface 148, creating another stream of bubbles. The conical shape of the member 132 (i.e., the member 132 being narrowed at the rear end 144 and wider at its front end 142) makes it easier to form the bubble film because (i) gravity pulls the bubble solution through the conical shape to better spread the bubble solution, and (ii) the narrowed rear and widened front accelerates air passing from the rear to the front in that the air is forced through the narrowed rear and expands and accelerates towards the widened front. As a result, the bubble producing device 36 is more effective in creating a stream of bubbles.

The bottom part 89 of the barrel 88 functions to define a collection space that can collect and receive droplets of bubble solution that have dripped or leaked from the bubble producing device 36, and deliver these droplets of bubble solution back into the interior of the solution container 24 via a tubing 160. See FIG. 3. The tubing 160 extends through the connector 30 into the solution container 24.

The assembly 20 operates in the following manner. When the user turns on the switch 26 (e.g., by pressing it), the switch 26 engages the contact 54 to form a closed electrical circuit, thereby turning on the motor 48. When the motor 48 turns on, it simultaneously (i) actuates the pump system in the manner described above to draw bubble solution from the solution container 24 to the bubble producing device 36, and (ii) causes the fan 68 to generate air that is blown through the barrel 88 at the bubble producing device 36, thereby generating streams of bubbles in the manner described above.

To stop producing streams of bubbles, the user merely releases the switch 26, thereby causing the switch 26 and the contact 54 to dis-engage, so that the motor 48 turns off, stopping the fan 68 and the action of the pump system.

Thus, the present invention provides a novel and unique bubble producing device 36 that eliminates the need for a space-consuming linkage system that is normally needed to form a film of bubble solution. As a result, the overall size of the assembly 20 can be reduced, and the complexity of the inner components can be simplified, thereby reducing costs.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A bubble generating assembly, comprising:

a housing having a motor, an air generator, tubing, and a bubble producing device associated therewith;

a source of bubble solution coupled to the bubble producing device via the tubing; and a pump system provided inside the housing that draws bubble solution from the source to the bubble producing device;

wherein the bubble producing device includes a tubular member having an inner surface and an outer surface, and at least one flow opening in the tubular member, and the tubular member longitudinally aligned with the air generator so that air from the air generator will flow along both the inner and outer surfaces; and a bubble solution flow path which extends from the source of bubble solution through the tubing to the interior of the tubular member, along the inner surface of the tubular member, and through the at least one flow opening to the outer surface of the tubular member such that bubble solution coats both the inner and outer surfaces.

2. The assembly of claim 1, wherein the tubular member has a generally conical configuration.

3. The assembly of claim 1, wherein the tubular member has a narrowed rear end and a front end that has a greater diameter than the diameter of the rear end.

4. The assembly of claim 1, wherein the bubble producing device further includes a housing, with the tubular member retained inside the housing and having spacers for spacing the outer surface of the tubular member from the housing.

5. A bubble generating assembly, comprising:

a housing having a motor, an air generator and a bubble producing device associated therewith;

a source of bubble solution, and tubing that fluidly connects the source of bubble solution to the bubble producing device; and a pump system provided inside the housing that draws bubble solution from the source to the bubble producing device;

wherein the bubble producing device includes:

a cylindrical housing having a cylindrical wall and an opening provided in the cylindrical wall;

a tubular member retained inside the cylindrical housing and having an inner surface and an outer surface, with at least one spacer positioned between the outer surface of the tubular member and the cylindrical wall, the tubular member longitudinally aligned with the air generator, and having a tubular wall with an opening extending through the tubular wall that is aligned with the opening of the cylindrical housing; and a bubble solution flow path defined by the tubing, the opening in the cylindrical wall and the opening in the tubular wall that delivers bubble solution to the inner surface of the tubular member; wherein the tubular wall has a plurality of flow openings, and the bubble solution flow path further delivers bubble solution from the inner surface through one of the flow openings to coat the outer surface.

6. The assembly of claim 5, wherein the tubular member has a generally conical configuration.

7. The assembly of claim 5, wherein the tubular member has a narrowed rear end and a front end that has a greater diameter than the diameter of the rear end.

8. A method of forming bubbles, comprising:

a. providing a bubble generating assembly having:

a housing having a motor, an air generator, tubing, and a bubble producing device associated therewith;

a source of bubble solution coupled to the bubble producing device via the tubing; and a pump system provided inside the housing that draws bubble solution from the source to the bubble producing device;

wherein the bubble producing device includes a tubular member having an inner surface and an outer surface, and at least one flow opening in the tubular member, b. longitudinally aligning the tubular member with the air generator;

c. flowing bubble solution from the source of bubble solution through the tubing to the interior of the tubular member, along the inner surface of the tubular member, and through the at least one flow opening to the outer surface of the tubular member such that bubble solution coats both the inner and outer surfaces; and d. blowing air along both the inner and outer surfaces.

9. The method of claim 8, further comprising:

providing the bubble producing device with a cylindrical housing that surrounds the tubular member;

spacing the outer surface of the tubular member from the cylindrical housing; and blowing air through the space defined by the outer surface of the tubular member and the cylindrical housing.

10. The method of claim 9, further including:

flowing bubble solution from the tubing through an opening in the cylindrical housing and another opening in the tubular member to the inner surface of the tubular member.

* * * * *